United States Patent [19]

Stack, Jr.

[11] Patent Number: 4,625,774

[45] Date of Patent: Dec. 2, 1986

[54] CONDUCTOR UNWRAPPING ATTACHMENT FOR MOTOR DRIVEN TOOL

[75] Inventor: Paul D. Stack, Jr., Cadillac, Mich.

[73] Assignee: Cooper Industries, Inc., Houston, Tex.

[21] Appl. No.: 786,905

[22] Filed: Oct. 11, 1985

[51] Int. Cl.[4] ..... B21F 15/04

[52] U.S. Cl. ..... 140/123; 81/57.31

[58] Field of Search ..... 140/122, 123, 124; 408/124, 139, 140, 141; 81/57.31; 242/7.17

[56] References Cited

U.S. PATENT DOCUMENTS

| | | | |
|---|---|---|---|
| 1,975,984 | 10/1934 | Stoll | 81/57.31 |
| 3,172,517 | 3/1965 | Moore | 140/124 |
| 3,752,595 | 8/1973 | Woythal et al. | 408/124 |

*Primary Examiner*—Lowell A. Larson

*Attorney, Agent, or Firm*—Eddie E. Scott; Alan R. Thiele

[57] ABSTRACT

An attachment for a conductor wrapping tool for providing a reduced rotation speed for driving a conductor unwrapping bit. The attachment includes a housing having an elongated reduced diameter portion for supporting a drive shaft wherein the housing and drive shaft may be supported by and in driving engagement with a motor driven conductor wrapping tool in place of a conductor wrapping bit and sleeve assembly. The housing supports a two stage planetary gear reduction drive for driving an unwrap bit at a substantially reduced speed with respect to the drive speed of the conductor wrapping tool motor and the attachment drive shaft. The unwrapping bit and drive shaft are coaxial and the attachment is adapted for rapid chucking and removal operations with respect to the conductor wrapping tool.

9 Claims, 3 Drawing Figures

CONDUCTOR UNWRAPPING ATTACHMENT FOR MOTOR DRIVEN TOOL

BACKGROUND OF THE INVENTION

1. Field of the Invention

The present invention pertains to an attachment for a motor driven conductor wrapping tool which provides for low speed driving of a conductor unwrapping bit for uncoiling a coiled wire termination.

2. Background

In the art of providing electrical conductor terminations by forming a coiled wire connection around a terminal pin the quality of the coiled or wrapped connection is tested by unwrapping the coils or helical convolutions of wire from the terminal pin to determine if wire breakage occurs. If the wire is uncoiled carefully stress induced by a poor quality coiling operation will result in wire breakage. However, if the wire is not carefully and slowly uncoiled during the quality check the coils may be subject to breakage by the act of the uncoiling operation itself, thereby rendering impossible the determination of the reason for the wire failure.

Although wire uncoiling or unwrapping operations have been carried out by manual tools or tools with manually actuated mechanisms these operations are slow and the inconsistency with which the uncoiling operation takes place sometimes results in failure of the uncoiled portion of the wire due to erratic or sudden changes in speed or stressing of the wire during the uncoiling process. On the other hand prior art motor driven wrapping tools are not well suited to unwrapping operations because they operate at very high speeds which also preclude the performance of a low stress uncoiling operation.

Accordingly, there has been a long felt desire to provide a device in the form of an attachment which can be attached to motor driven conductor wrapping tools for use in unwrapping coiled wire terminations for checking the quality of the connection and the performance of the bits which are used to provide the wrapped or coiled connections. In this regard it is highly desirable that the socalled unwrap or uncoiling attachment be conveniently adapted for use with motor driven conductor coiling or wrapping tools wherein the unwrapping attachment may be used as a replacement for the combination coiling or wrapping bit and sleeve assembly used in the coiling operation so that the motor driven tool itself can be used for both coiling and uncoiling operations. The conductor unwrapping or uncoiling attachment of the present invention solves the aforementioned problems in the art of conductor uncoiling and conductor wrapping bit qualifying tests.

SUMMARY OF THE INVENTION

The present invention provides an attachment for a motor driven conductor coiling tool which is adapted to be connected to the tool in place of the conventional conductor coiling or wrapping bit and provide a low speed unwrapping bit for unwrapping or uncoiling a coiled wire termination at a uniform and sufficiently slow speed that no unusual stresses are induced in the conductor wire during the uncoiling operation.

In accordance with one aspect of the present invention there is provided a conductor unwrapping attachment having a housing for supporting a reduction gear drive system, which housing has an elongated support portion which is adapted to be received within the collet or receiving bore of a motor driven conductor wrapping tool. The unwrapping attachment housing supports a driven bit member which is driven at a substantially reduced speed with respect to an input drive shaft and which is provided with means for engaging a portion of a coiled conductor wire termination to unwrap the wire coils or convolutions from a terminal pin.

In accordance with yet another aspect of the present invention there is provided a conductor unwrapping attachment which includes a drive shaft portion for connection to a drive member of a conductor wrapping tool in place of a conductor wrapping bit and which is drivably connected to a reduction gear drive train for reducing the rotative output speed of the tool whereby a uniform and slow driven speed of the conductor unwrap bit may be provided.

In accordance with still a further aspect of the present invention there is provided a conductor unwrapping attachment which may be easily connected to a conductor wrapping tool in place of the rotary wrapping bit and which provides a substantially reduced output speed for a conductor unwrapping bit or driven member due to the provision of a two stage planetary type gear drive interposed between a drive shaft member which is connected to the tool drive train and the unwrapping bit member.

The above described features and advantages of the present invention as well as additional superior aspects thereof will be further appreciated by those skilled in the art upon reading the detailed description which follows in conjunction with the drawing.

DESCRIPTION OF A PREFERRED EMBODIMENT

Figure 3:
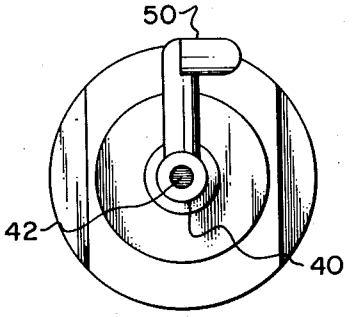
FIG. 3 is an end elevation of the conductor unwrapping attachment of the present invention.

In the description which follows like parts are marked throughout the specification and drawing with the same reference numerals, respectively. The drawing figures are not necessarily to scale and certain features of the invention may be shown exaggerated in scale in the interest of clarity.

Figure 1:
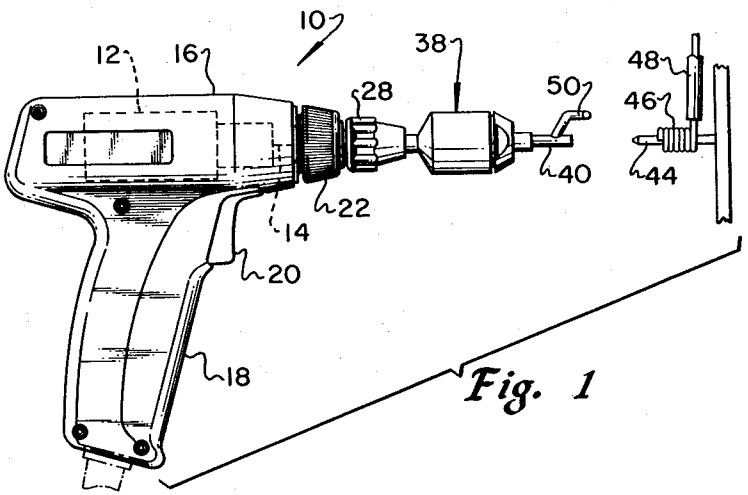
FIG. 1 is a side elevation of a motor driven conductor wrapping tool including the unwrapping attachment of the present invention.

Referring to FIG. 1, there is illustrated a conductor wrapping tool generally designated by the numeral 10. The tool 10 is similar in some respects to conductor wrapping tools described and claimed in U.S. Pat. Nos. 3,464,527 to W. J. Baker and 4,175,247 to R. J. Klemm, both patents assigned to the assignee of the present invention. The tool 10 includes a fluid or electrically energized motor 12 having a rotatably driven drive member 14 operably connected thereto. The motor 12 is disposed in a suitable housing 16 including a depending hand grip portion 18 and an operator actuatable trigger 20. A forward portion of the housing 16 is configured as a removable collar or nut 22, see FIG. 2, also, which includes bearing means for supporting a rotatable drive member 24, FIG. 2, drivably connected to the drive shaft 14.

A forward distal portion of the collar 22 is adapted to retain a collet 26 which threadedly receives a collet nut 28 normally provided for receiving an elongated conductor wrapping bit and sleeve assembly, not shown. Various types of conductor wrapping bits and sleeve assemblies are operable to be inserted in an elongated bore 30 formed in the collet 26. A locating pin 32 is also provided in the collet 26 for rotationally orienting the aforementioned sleeve portion of the conductor wrapping bit and sleeve assembly.

The present invention is configured as an attachment for the motor driven tool 10 and which is generally designated by the numeral 38. The attachment 38 is adapted to rotatably drive a coiled conductor uncoiling bit 40. The uncoiling or unwrapping bit 40 has an elongated bore 42 formed in the distal end thereof, see FIGS. 2 and 3, for receiving the end of a terminal pin or the like as illustrated in FIG. 1 and generally designated by the numeral 44. The pin 44 is part of a conductor wire termination which is formed by coiling a flexible electrical conductor wire 46 around the pin in a series of helical convolutions in accordance with a technique known in the art. The conductor wire 46 typically includes an insulated portion 48 which extends to another terminal pin or to some other type of electrical circuit component, not shown.

The quality of coiled wire terminations in many application is very critical and in order to determine the performance of a conductor coiling or wrapping bit the coiled portion of the conductor wire is slowly uncoiled without unduly stressing the coils so that any preinduced stress resulting from improper coiling operation or faulty coiling bit configuration may be determined as a form of quality control check in the mass production of these types of terminations. Accordingly, it is of the utmost importance that the conductor wire be carefully and slowly unwrapped from the terminal pin 44 such as, for example, by engaging the insulated portion 48 by a radially projecting finger 50 extending from the unwrapping bit 40. Upon rotation of the bit 40 in the direction provided for initially forming the coiled connection, the wrapped convolutions of wire may be uncoiled to measure their structural integrity and to determine if a possible connection failure mode has been induced by a faulty coiling operation. The uniformly slow uncoiling speed provided for the bit 40 is due to the improved attachment 38, which is particularly adapted for use with a motor driven tool such as the tool 10.

Figure 2:
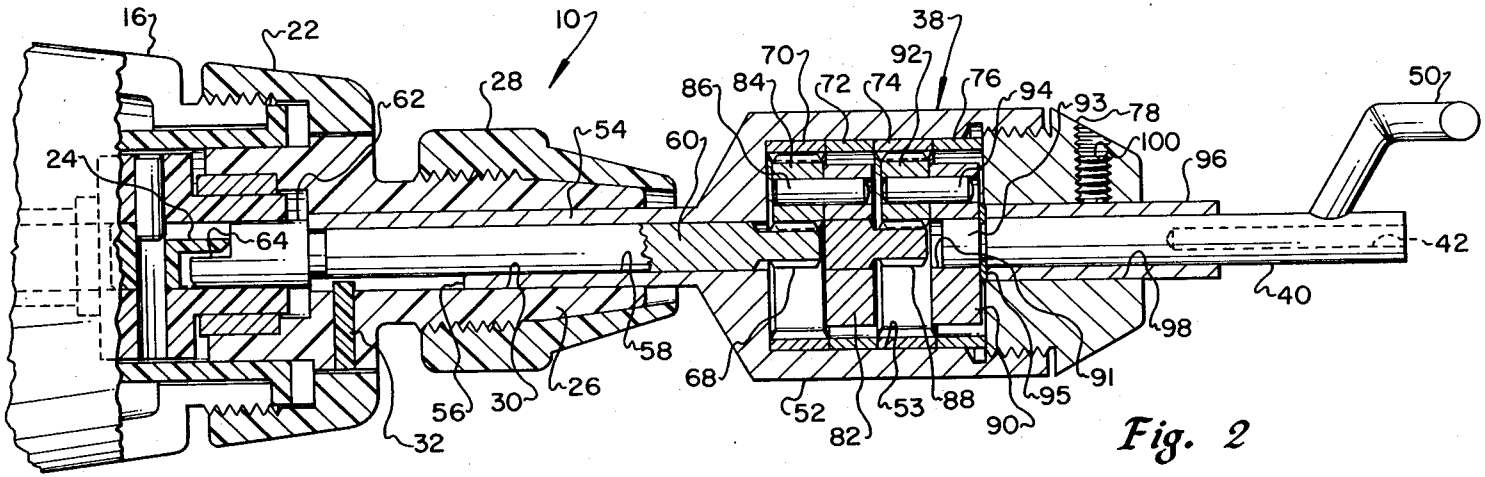
FIG. 2 is a longitudinal central section view of the unwrapping attachment shown connected to a portion of the drive train of the conductor wrapping tool.

Referring now primarily to FIG. 2, the unwrapping attachment 38 includes a generally cylindrical housing member 52 having an integral elongated cylindrical portion 54 of a diameter sufficient to be slidably receivable in the bore 30. A longitudinal locating slot 56 is formed in the wall of the cylindrical portion 54 for accommodating the sleeve locating pin 32. The housing 52, including its reduced diameter cylindrical portion 54, is formed with an elongated bearing bore 58 for journalling a drive shaft member 60. The drive shaft 60 is coaxial with the unwrap bit 40 and includes a tang 62 having a drive flat 64 for driving engagement with the tool drive member 24. The configuration of the tang 62 is essentially the same as the configuration of the drive tang of a conventional conductor wrapping bit so that the reduced diameter portion 54 of the housing 52 and the drive tang 62 occupy the position allotted for a conductor wrapping bit and sleeve assembly which has been removed from the collet 26 in favor of the unwrapping attachment 38.

The end of the drive shaft 60 opposite the tang 62 is preferably formed as an integral gear or pinion 68 forming part of a planetary gear drive. The housing 52 includes an enlarged bore 53 for receiving the planetary gear drive which further includes a first stationary ring gear 70, a spacer 72, a second stationary ring gear 74, and another spacer 76, all of which are retained in the bore 53 by a removable head member 78. The head member 78 is threadedly engaged with the housing 52 for retaining the aforementioned components stationary in the bore 53.

The planetary gear drive further includes a first rotatable planet carrier 82 for supporting one or more planet gears 84, one shown in FIG. 2, rotatably supported on a pin type shaft 86 extending from the planet carrier 82. The planet carrier 82 includes a second drive pinion 88 forming the sun gear for a second planetary gear stage including a planet gear carrier 90 supporting one or more planet gears 92, one shown in FIG. 2, supported on a bearing shaft 94. The planet carrier 90 is suitably secured for rotation with the unwrap bit 40 such as by the provision of a polygonal bore 91 which receives a correspondingly shaped drive end 93 of the bit 40. The unwrap bit 40 is journalled for rotation in a sleeve 96 which is secured in a bore 98 in the head 78 by a set screw 100.

The bit 40 is retained in the sleeve 96 by a suitable retaining ring 95. Thanks to the two stage planetary gear drive system provided by the pinion or sun gear 68, ring gear 70, first stage planet carrier 82 sun gear 88, and the second stage planet carrier 90 together with the ring gear 74 and the planet gears 84 and 92, a very high gear reduction ratio may be obtained for the rotative output speed of the unwrapping bit 40 with respect to the drive shaft 60. For example, a speed reduction ratio is in the range of 40 to 1 may be obtained with a relatively compact two stage planetary gear reduction drive arrangement whereby the conventional output speed of the drive member 24 in the range of 4,000 RPM may be reduced to an output speed of the unwrap bit 40 of about 100 RPM. Accordingly, with the provision of the speed reducing attachment 38 for supporting and rotatably driving an unwrapping bit or device such as the unwrapping bit 40, conventional motor driven conductor wrapping tools such as the tool 10 may be used in conductor unwrapping operations also. The attachment 38 is particularly adapted for use with tools wherein a relatively constant motor speed is provided upon energization of the tool motor so that a consistent and relatively slow speed conductor unwrapping or uncoiling operation may be performed.

In the operation of the attachment 38 the tool 10 is prepared for receiving the attachment by loosening the collet nut 28 to permit removal of the aforementioned wrapping bit and sleeve assembly from the collet 26. Upon removal of the conventional conductor wrapping bit and sleeve assembly the attachment 38 is connected to the tool 10 by inserting the reduced diameter sleeve portion 54 of the housing 52 into the bore 30 until the bit drive surface 64 engages the drive member 24 whereupon the collet nut may be tightened in a conventional manner to retain the attachment connected to the tool. The attachment 38 is then applied to perform an unwrapping operation in conjunction with the tool 10 by presenting the bit 40 to the terminal pin 44 with the pin extending at least partially into the bore 42. The insulated portion 48 of the wire connection is then dressed over the finger 50 and the tool energized to commence rotation of the bit 40 in the same direction of the wrap whereupon the conductor is unwound or uncoiled from the terminal pin 44 to determine the quality of the wrapped connection. By merely loosening the collet nut 28 the attachment 38 may be removed from the collet 26 and the wrapping bit and sleeve assembly previously mentioned but not shown may then be replaced in the collet for operation of the tool in use to perform wrapped connections.

The components of the attachment 38 may be made from conventional engineering materials and fabricated using conventional manufacturing techniques. Lubrication of the gearing may be provided, if necessary, by conventional lubricants in the chamber formed by the housing bore 53.

Although a preferred embodiment of the present invention has been described herein in detail, those skilled in the art will recognize that various substitutions and modifications may be made to the embodiment described without departing from the scope and spirit of the invention as recited in the appended claims.

What I claim is:

1. A device for rotatably driving a conductor unwrapping bit and for connection to a motor driven tool to be driven thereby, said tool including a drive member and means for supporting a conductor wrapping bit and sleeve assembly, said device comprising;

a housing including an elongated cylindrical portion adapted to be supported by said means on said tool, said cylindrical portion including a bore for rotatably supporting an elongated drive shaft, said drive shaft including means engageable with said drive member to be rotatably driven thereby;

a conductor unwrapping bit rotatably supported on said housing; and speed reduction gear means disposed in said housing and drivably interconnecting said unwrapping bit with said drive shaft for driving said unwrapping bit at a reduced speed with respect to the speed of rotation of said drive shaft.

2. The device set forth in claim 1, wherein:

said housing includes a removable head portion including means forming a bore therein, sleeve means disposed in said bore and forming bearing means for rotatably supporting said unwrapping bit.

3. The device set forth in claim 1, wherein:

said drive shaft and said unwrapping bit are supported on said housing in coaxial alignment with each other.

4. The device set forth in claim 3, wherein:

said speed reduction gear means comprises planetary gear means wherein said drive shaft includes a sun gear drivably connected thereto and meshed with at least one planet gear, and said planetary gear means includes a planet carrier supporting said planet gear and drivably connected to said unwrapping bit.

5. The device set forth in claim 4, wherein said speed reduction gear means includes a two stage planetary gear set, said sun gear on said drive shaft comprising the sun gear of one planetary gear stage and the planet carrier of said one planetary gear stage being drivably connected to a second sun gear of a second planetary gear stage.

6. The device set forth in claim 5, wherein:

said planetary gear set includes ring gear means supported in said housing and secured therein against rotation relative to said housing by a removable head portion of said housing.

7. A device for rotatably driving a conductor unwrapping bit and for connection to a motor driven tool to be driven thereby, said tool including a drive member and collet means for releasably supporting a conductor wrapping bit and sleeve assembly, said device comprising;

a housing including a portion adapted to be supported by said collet means, said portion including means for rotatably supporting a drive shaft, said drive shaft including means engageable with said drive member to be rotatably driven thereby;

a conductor unwrapping bit rotatably supported on said housing in coaxial alignment with said drive shaft and including a part engageable with an uncoiled conductor wire portion; and speed reduction gear means disposed in said housing and drivably interconnecting said unwrapping bit with said drive shaft for driving said unwrapping bit at a reduced speed with respect to the speed of rotation of said drive shaft.

8. The device set forth in claim 7, wherein:

said housing includes a head portion supporting sleeve means operable to form bearing means for rotatably supporting said unwrapping bit.

9. A device for rotatably driving a conductor unwrapping bit and for connection to a rotary tool to be driven thereby, said tool including a drive member and means for releasably supporting a conductor wrapping bit and sleeve assembly, said device comprising;

a housing including an elongated portion adapted to be supported by said means on said tool, said portion including a bore for rotatably supporting an elongated drive shaft, said drive shaft including means engageable with said drive member to be rotatably driven thereby;

a rotatable conductor unwrapping bit rotatably supported on said housing; and speed reduction gear means disposed in said housing and drivably interconnecting said unwrapping bit with said drive shaft for driving said unwrapping bit at a reduced speed with respect to the speed of rotation of said drive shaft;

said speed reduction gear means including planetary gear means including a first sun gear drivably connected to said drive shaft and meshed with at least one planet gear, a first planet carrier supporting said planet gear and drivably connected to said unwrapping bit, a second sun gear drivenly connected to said first planet carrier, a second planet carrier including a planet gear meshed with said second sun gear, and means forming a driving connection between said unwrapping bit and said second planet carrier.

* * * * *